US012593944B1

(12) United States Patent
Fragoso, Jr.

(10) Patent No.: US 12,593,944 B1
(45) Date of Patent: Apr. 7, 2026

(54) EXTENDABLE BATHING SCRUBBER

(71) Applicant: Emilio Fragoso, Jr., Tucson, AZ (US)

(72) Inventor: Emilio Fragoso, Jr., Tucson, AZ (US)

( * ) Notice: Subject to any disclaimer, the term of this patent is extended or adjusted under 35 U.S.C. 154(b) by 348 days.

(21) Appl. No.: 18/227,445

(22) Filed: Jul. 28, 2023

(51) Int. Cl.
*A47K 7/04* (2006.01)
*A47K 7/02* (2006.01)

(52) U.S. Cl.
CPC ..... *A47K 7/043* (2013.01); *A47K 7/028* (2013.01)

(58) Field of Classification Search
CPC ..... A47K 7/043; A47K 7/028
See application file for complete search history.

(56) References Cited

U.S. PATENT DOCUMENTS 3,103,682 A 9/1963 Louise
5,167,069 A * 12/1992 Quinn ..... B26B 21/523 D28/48
6,823,555 B2 * 11/2004 Warren ..... A47K 7/028 15/210.1
2020/0288919 A1 * 9/2020 Al Hamli ..... A47L 11/12

* cited by examiner

*Primary Examiner* — Shay Karls
(74) *Attorney, Agent, or Firm* — Sanchelima & Associates, P.A.; Jesus Sanchelima; Christian Sanchelima

(57) ABSTRACT

An extendable bathing scrubber including a handle assembly, a telescopic assembly, and a sponge assembly. The telescopic assembly includes a pole with multiple sections inserted therebetween, creating a telescopic pole. One end of the pole serves as a handle that allows the user to manipulate the extended pole. The opposite end of the pole integrates sockets configured to receive caps, defining a snap fastener that enables the attachment and detachment of a loofah as needed. The pole can remain collapsed by means of a telescopic mechanism integrated inside a section of the pole. To achieve an extended configuration the telescopic mechanism is unlocked, and the pole joints are twisted to secure the extended position.

7 Claims, 3 Drawing Sheets

EXTENDABLE BATHING SCRUBBER

II. BACKGROUND OF THE INVENTION

1. Field of the Invention

The present invention relates to a bathing scrubber and, more particularly, to an extendable bathing scrubber that includes a handle coupled to an extendable pole with a replaceable sponge, such as a loofah to provide an efficient means of bathing.

2. Description of the Related Art

Several designs for extendable bathing scrubbers have been designed in the past. None of them, however, include a pole housed inside a handle, wherein the pole includes interlocking sections capable of being extended through a telescopic mechanism extended from the handle by means of a button. At the end of the pole, a loofah is coupled, providing a portable device for cleaning and exfoliating.

Applicant believes that a related reference corresponds to U.S. Pat. No. 6,823,555 issued for backwash brush and kit therefore. Applicant believes that another related reference corresponds to U.S. Pat. No. 3,103,682 issued for lotion applicator. None of these references, however, teach of a telescopically extendable handle with a replaceable scrubber head, wherein the head is a loofah.

Other documents describing the closest subject matter provide for a number of more or less complicated features that fail to solve the problem in an efficient and economical way. None of these patents suggest the novel features of the present invention.

III. SUMMARY OF THE INVENTION

It is one of the objects of the present invention to provide a device that allows the user to preserve the telescopic device while replacing the loofah.

It is another object of this invention to provide a device that could easily be stored as well as transported.

It is still another object of the present invention to provide a snap system that allows for convenient replacement of the loofah when necessary.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

IV. BRIEF DESCRIPTION OF THE DRAWINGS

Figure 1:
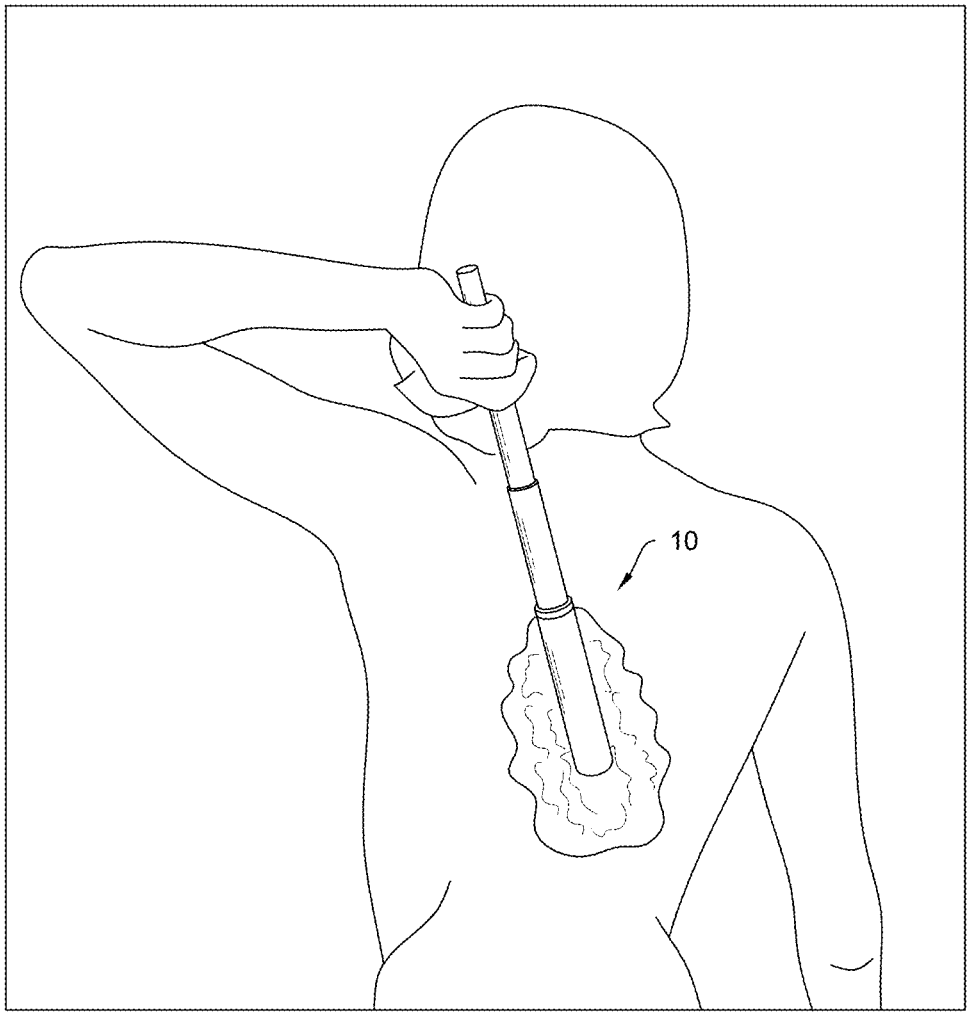

With the above and other related objects in view, the invention consists in the details of construction and combination of parts as will be more fully understood from the following description, when read in conjunction with the accompanying drawings in which:

FIG. 1 represents an operational view of an exemplary embodiment of the present invention 10.

Figure 2:
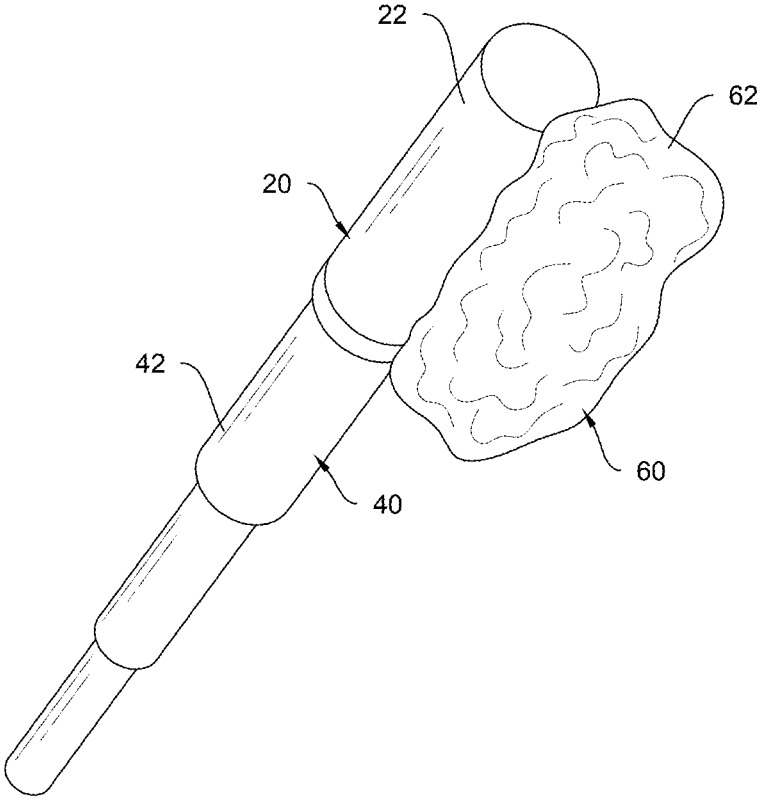

FIG. 2 shows an isometric view of the present invention 10 when extended and with the loofah 62 coupled to the pole 42.

Figure 3:
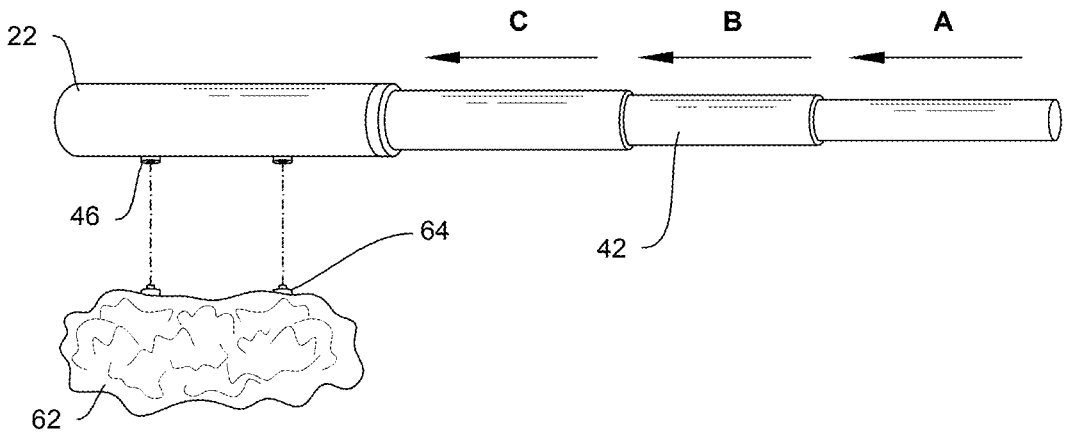

FIG. 3 illustrates a lateral perspective view of the present invention 10 when extended and the loofah 62 uncoupled.

Figure 4:
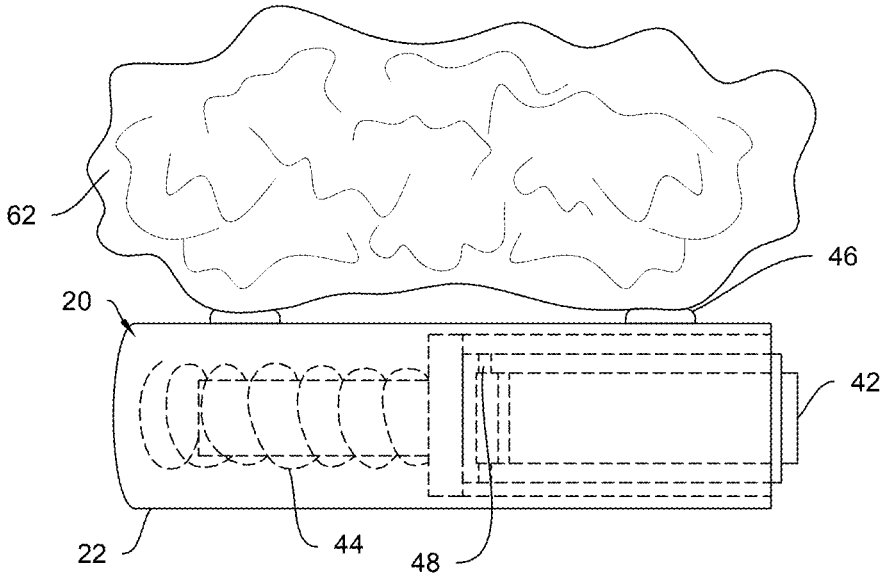

FIG. 4 is a representation of a transparent lateral view of the handle assembly 20 housing the telescopic mechanism 44, providing a collapsed configuration of the pole 42.

V. DETAILED DESCRIPTION OF THE EMBODIMENTS OF THE INVENTION

Referring now to the drawings, where the present invention is generally referred to with numeral 10, it can be observed that it basically includes a handle assembly 20, a telescopic assembly 40, and a sponge assembly 60. It should be understood there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

Handle assembly 20 includes a handle 22, and a button 24. In an exemplary embodiment, the last section of a pole 42 serves as the handle 22, providing a suitable grip for the user, best depicted in FIG. 1. The handle 22 is ergonomically configured to enhance control and maneuverability during use. In a suitable embodiment, handle 22 may be made of durable plastics, such as ABS, polypropylene, or any other suitable plastic. Nonetheless, it should be considered that handle 22 may be made of stainless steel or aluminum. In a suitable embodiment, the handle 22 may feature a textured surface coating to improve grip when used. In a preferred embodiment, handle 22 may feature a cylindrical configuration. It should be considered that a portion of the base of the handle 22 may be threaded, and the tip of the next section may include a threaded portion to securely lock into each other when extended, as FIG. 2 illustrates. In a suitable variation, the handle may include a tapered configuration, where the diameter thereof gradually increases from the tip to the base. This configuration prevents the handle from sliding out. A hollow body for the handle may be considered.

Telescopic assembly 40 includes the pole 42, a telescopic mechanism 44, and sockets 46. In an exemplary embodiment, pole 42 comprises multiple sections that can be extended or retracted as needed, defining a telescopic pole, best depicted in FIG. 3 and FIG. 4. In a preferred embodiment, each section of the pole 42 is configured with a cylindrical shape, where a top portion and a bottom portion thereof is threaded to securely lock the junctions of the sections when extended, preventing unintentional collapsing when using. Nevertheless, in a suitable variation thereof, each section of the pole 42 is configured with a tapered shape, where the diameter gradually decreases from the base to the tip. This tapered configuration allows for easy insertion and interlocking of the sections. In a preferred embodiment, the pole 42 may be made of durable plastics, such as ABS, polypropylene, or any other suitable plastic. Nonetheless, it should be considered that pole 42 may be made of stainless steel or aluminum.

Referring to FIG. 4, the pole 42 integrates inside of one of the sections thereof the telescopic mechanism. In a preferred embodiment, the telescopic mechanism 44 may be a push-button release mechanism, a push-push mechanism, a button-locking pin mechanism, or any other suitable mechanism that allows the pole 42 to remain collapsed and released by pushing the tip thereof. This configuration allows the sections of the pole 42 to be locked in place by pushing the smaller section of the pole 42 inward. The mechanism engages with corresponding slots or grooves, creating a secure and stable connection, ensuring that the pole remains collapsed. When the telescopic mechanism 44 is pressed or pushed by means of the smaller section of the pole 42, the mechanism disengages the corresponding slots or grooves to unlock and release the pole 42 from the collapsed configuration, allowing the pole 42 to be extended and secured this configuration by twisting and locking the joints of each section by means of the threaded portions thereof.

As best observed in FIG. 4, a section of the pole 42 integrates sockets 46 on the outer surface of the adjacent side of the pole 42. In a suitable embodiment, sockets 46 are configured to receive caps 64, creating a reliable connection therebetween. In a preferred embodiment, sockets 46 and caps 62 are complementary male and female components, typically in the form of protruding studs and corresponding receptacles, as best illustrated in FIG. 3.

Sponge assembly 60 includes a loofah 62, and caps 64. In an exemplary embodiment, loofah 62 may be a porous and textured sponge-like material used for exfoliating and cleansing, as FIG. 1 represents. In a suitable embodiment, the loofah 62 is typically made of natural or synthetic fibers woven together to create a textured surface. In one embodiment, the loofah 62 may have a predetermined shape and dimension that align with the section of the pole 42 that integrates the sockets 46, as FIG. 3 shows. In a preferred embodiment, the loofah 62 incorporates the caps 64 in a predetermined configuration that aligns with the sockets 46, where the sockets 46 and caps 64 defines snap fasteners. The integration of snap fasteners allows the loofah 62 to be coupled and uncoupled when needed, allowing the user to replace and dispose of the loofah 62 but conserving the pole 42. In an exemplary embodiment, the loofah 62 is configured to provide an extension when exfoliating a predetermined part of the body, as FIG. 1 illustrates. Nonetheless, when handle 22 is in a collapsed configuration, a section of the pole 42 serves as a handle, allowing the user to attach the loofah 62 to the pole 42, as best depicted in FIG. 4. This arrangement creates a handheld device for exfoliating and cleansing various areas of the body with the loofah 62. When handle 22 is collapsed, pole 42 becomes shorter. This enables the user to hold the loofah 62 directly in hand, allowing for more precise and controlled exfoliating and cleansing. It should be considered that the sections of the pole 42 where the sockets are positioned, may include a textured surface coating to improve grip when used.

In a suitable variation, the versatile socket 46 and cap 64 system allows for the use of various types of sponges, offering users a customizable bathing experience. In addition, different sponge types, such as soft foam sponges, massaging sponges, textured sponges, or any other type of cleansing devices known in the art, may integrate caps 64 for easy attachment attached to the pole 42.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. An extendable bathing scrubber, comprising:

a) a telescopic body comprising concentric tube sections that slide to adjust the length of the telescopic body: wherein a bottomost section of said telescopic body defines a handle; wherein a topmost section of the telescopic body comprises a cylindrical body having sockets on an outer surface thereof; said sockets are aligned along a longitudinal axis of the topmost section; internally, the telescopic body features a release mechanism comprising a spring-loaded lock, so that when the telescopic body is in a collapsed configuration, the telescopic body is extended by pressing the bottomost section to release the spring-loaded lock; a loofah including caps disposed along a longitudinal axis thereof, wherein said caps are aligned with said socket so that the loofah is secured to said telescopic body by connecting the caps and the sockets.

2. The extendable bathing scrubber of claim 1, wherein said handle is configured with a cylindrical shape.

3. The extendable bathing scrubber of claim 1, wherein said pole integrates a threaded on each junction of said multiple sections thereof to secure an extended configuration of said pole.

4. The extendable bathing scrubber of claim 1, wherein said telescopic mechanism secures in said collapsed configuration by inserting said multiple sections into each other and pushing said handle to lock said telescopic mechanism.

5. The extendable bathing scrubber of claim 1, wherein said loofah provides a textured surface for exfoliating and cleansing.

6. The extendable bathing scrubber of claim 1, wherein said caps and said sockets are complementary female and male components to fasten said loofah to said pole, providing a replaceable loofah.

7. An extendable bathing scrubber, consisting of:

a) a telescopic body comprising concentric tube sections that slide to adjust the length of the telescopic body; wherein a bottomost section of said telescopic body defines a handle; wherein a topmost section of the telescopic body comprises a cylindrical body having sockets on an outer surface thereof; said sockets are aligned along a longitudinal axis of the topmost section; internally, the telescopic body features a release mechanism comprising a spring-loaded lock, so that when the telescopic body is in a collapsed configuration, the telescopic body is extended by pressing the bottomost section to release the spring-loaded lock;

b) a loofah including caps disposed along a longitudinal axis thereof, wherein said caps are aligned with said socket so that the loofah is secured to said telescopic body by connecting the caps and the sockets; said caps and said sockets are complementary female and male components to fasten said loofah to said pole, providing a replaceable loofah.

* * * * *